US006859976B2

(12) United States Patent
Plankenhorn

(10) Patent No.: US 6,859,976 B2
(45) Date of Patent: Mar. 1, 2005

(54) CLEANING APPARATUS WITH CONTINUOUS ACTION WIPING AND SWEEPING

(75) Inventor: Daniel J. Plankenhorn, Milwaukee, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 364 days.

(21) Appl. No.: 10/079,843

(22) Filed: Feb. 22, 2002

(65) Prior Publication Data

US 2003/0159223 A1 Aug. 28, 2003

(51) Int. Cl.[7] ..... A47L 11/30

(52) U.S. Cl. ..... 15/380; 15/364; 15/51; 15/99

(58) Field of Search ..... 15/41.1, 44, 52.1, 15/50.3, 52, 98, 99, 51, 228, 231, 380, 364, 320, 322

(56) References Cited

U.S. PATENT DOCUMENTS

| | | | | | |
|---|---|---|---|---|---|
| 500,976 | A | | 7/1893 | Tangenberg | |
| 2,601,537 | A | | 6/1952 | Lofgren | |
| 3,150,396 | A | | 9/1964 | Unterbrink | 15/98 |
| 3,150,407 | A | * | 9/1964 | Mitchell | 15/98 |
| 4,083,075 | A | * | 4/1978 | Hester | 15/231 |
| 4,369,544 | A | * | 1/1983 | Parisi | 15/320 |
| 4,433,451 | A | | 2/1984 | Parisi | 15/321 |
| 4,510,642 | A | | 4/1985 | Ingermann et al. | 15/231 |
| 4,550,467 | A | | 11/1985 | Johnson et al. | 15/228 |
| 4,562,610 | A | | 1/1986 | Davis et al. | 15/228 |
| 4,642,831 | A | | 2/1987 | Roth | |
| 4,646,380 | A | | 3/1987 | Kobayashi et al. | |
| 4,845,794 | A | * | 7/1989 | Korski et al. | 15/51 |
| 5,092,699 | A | | 3/1992 | Silvenis | 401/21 |
| 5,327,609 | A | | 7/1994 | Bierma et al. | 15/98 |
| 5,896,611 | A | | 4/1999 | Haaga | 15/42 |

FOREIGN PATENT DOCUMENTS

| | | |
|---|---|---|
| DE | 29910164 U1 | 7/1999 |
| DE | 29910165 U1 | 10/1999 |
| EP | 1203556 A2 | 5/2002 |
| WO | WO 9818380 | 5/1998 |
| WO | WO 02091901 | 11/2002 |

* cited by examiner

*Primary Examiner*—Theresa T. Snider

(57) ABSTRACT

A cleaning apparatus includes a housing to be moved along a surface to be cleaned. Within the housing, a cleaning ribbon is disposed between a supply reel and a take-up reel. A portion of the cleaning ribbon is held parallel to, and in substantial contact with, the surface to be cleaned, for attracting and retaining smaller debris. Another portion of the cleaning ribbon is configured to create a particle trap. A rotatable brush, also disposed within the housing, sweeps larger debris into the particle trap. The supply reel, the take-up reel, the cleaning ribbon, and/or the rotatable brush are alternatively included in a cartridge which is detachably secured within the housing.

73 Claims, 13 Drawing Sheets

CLEANING APPARATUS WITH CONTINUOUS ACTION WIPING AND SWEEPING

BACKGROUND OF THE INVENTION

1. Field of the Invention

This invention relates generally to a cleaning apparatus, and, in particular, to an apparatus especially suited for cleaning hard-surfaced floors.

2. Description of the Related Art

Cleaning floors is a tedious and laborious task. Over the years, many devices have been designed for this purpose, including brooms, mops, vacuum-cleaners, and countless variations thereon. For example, U.S. Pat. Nos. 5,896,611 and 500,976 each discloses a device that utilizes a rotatable brush to accelerate debris into a collection container. These devices have the ability to pick up relatively large dirt particles, but smaller items such as dust and hair are usually left behind. Additionally, these devices generally are designed for industrial applications, and therefore, tend to be too cumbersome for household use.

Meanwhile, widely-used electret cloth mops, which utilize static electricity to attract dirt, hair, and dust particles, pose the opposite problem. These devices are effective at picking up small particles, but larger debris tends to collect at the front edge of the mop where the debris is pushed across the floor until a user manually removes the debris from the floor. In addition, using electret cloth mops is time consuming because the user frequently has to replace spent electret cloth. Other floor cleaning devices, like those depicted in U.S. Pat. Nos. 5,092,699 and 5,372,609, attempt to solve this problem by providing a continually-fed cleaning cloth, but these devices are likewise incapable of picking up larger debris.

Accordingly, there is a need in the art for a cleaning apparatus that is capable of removing both large and small particles from a surface, yet is easily handled and operated.

SUMMARY OF THE INVENTION

This invention addresses the foregoing needs in the art by providing a cleaning apparatus with continuous action wiping and sweeping, in which a continuously-fed cleaning ribbon works in conjunction with a rotatable sweeping brush to remove both large and small debris from a hard-surfaced floor.

In a first aspect of the invention, the cleaning apparatus includes a housing and a handle attached to the housing. The housing houses a supply reel, a take-up reel, a cleaning ribbon extending between the supply reel and the take-up reel, and a rotatable brush. The cleaning ribbon is configured to form a particle trap, and the rotatable brush sweeps particles into the particle trap from a forward side of the particle trap.

In another aspect of the invention, a cleaning apparatus includes a housing and a handle attached to the housing. The housing detachably secures a cartridge. The cartridge includes a supply reel, a take-up reel, a cleaning ribbon extending between the supply reel and the take-up reel, and a rotatable brush. The cleaning ribbon is configured to form a particle trap, and the rotatable brush sweeps particles into the particle trap from a forward side of the particle trap.

In yet another aspect of the invention, a cleaning apparatus includes a housing and means for advancing the housing along a surface to be cleaned. The housing houses a supply reel for dispensing a supply of cleaning ribbon and a take-up reel for collecting spent cleaning ribbon. The housing additionally includes means for keeping a portion of the cleaning ribbon that extends between the supply reel and the take-up reel parallel to the surface to be cleaned, means for trapping particles, and means for sweeping particles into the particle trapping means.

In still another aspect of the invention, a cartridge for detachable securement within a cleaning apparatus includes a supply reel, a take-up reel, and a cleaning ribbon extending between the supply reel and the take-up reel. The cartridge further includes means for sweeping particles into a particle trap, and means for detachably securing the cartridge to the cleaning apparatus.

In a further aspect of the invention, a cartridge for detachable securement within a cleaning apparatus includes a supply reel, a take-up reel, and a cleaning ribbon extending between the supply reel and the take-up reel configured to create a particle trap. The cartridge also includes means for detachably securing the cartridge to the cleaning apparatus.

A better understanding of these and other objects, features, and advantages of the invention may be had by reference to the drawings and to the accompanying description, in which there are illustrated and described preferred embodiments of the invention.

DESCRIPTION OF THE PREFERRED EMBODIMENTS

For illustrative purposes, the preferred embodiments of a cleaning apparatus according to this invention are described in connection with the cleaning of floors. This invention, however, can be utilized in the cleaning of other surfaces, such as, for example, walls and sidewalks.

Figure 1:
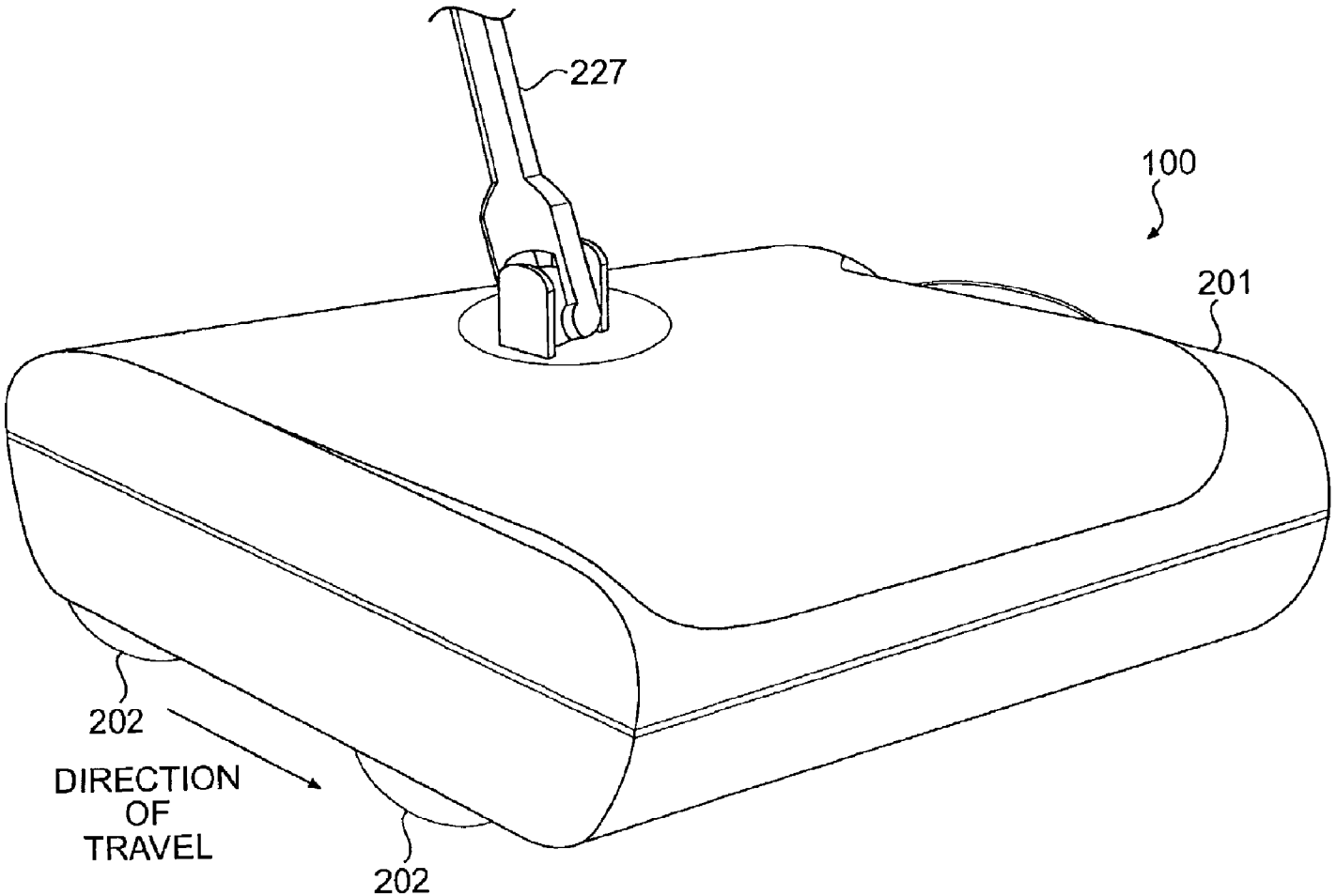
FIG. 1 is a perspective view of a preferred embodiment of a cleaning apparatus according to the present invention.

FIG. 1 illustrates a preferred embodiment of a cleaning apparatus 100 according to the invention. A housing 201 is attached to a distal end of a handle 227. A plurality of wheels 202, rotatably mounted to the housing 201, allows for easy manipulation of the cleaning apparatus 100 along a surface to be cleaned. In other embodiments, for example, the cleaning apparatus 100 may be propelled autonomously (e.g., an extension of a robotic cleaning device wherein the robot is pre-programmed to direct itself over a surface to be cleaned), or be electrically self-propelled (e.g., a plug-in or battery operated unit wherein the apparatus advances without user assistance and the user merely walks behind the apparatus to direct the apparatus). For these alternate embodiments, a handle may not be necessary.

Figure 2:
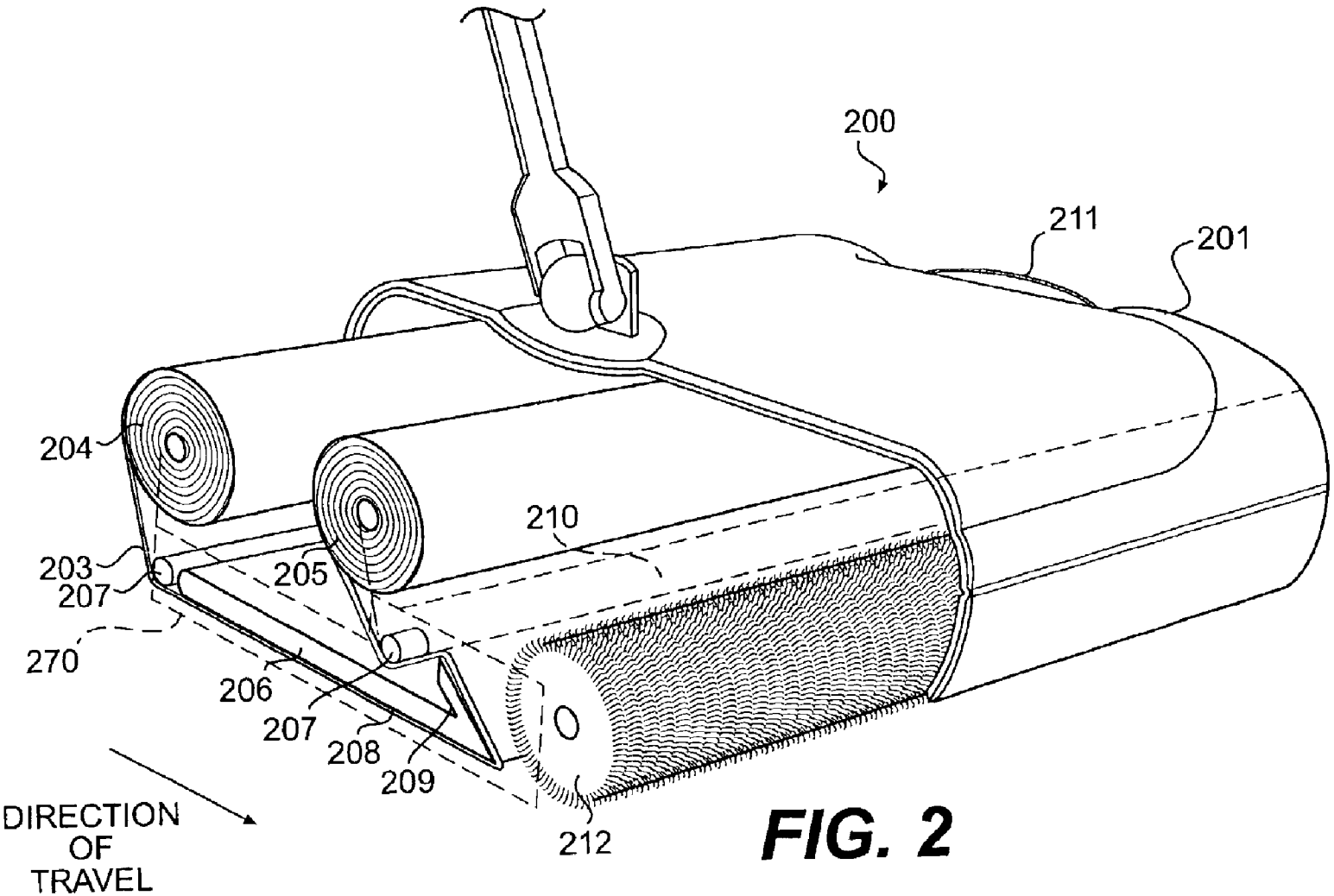
FIG. 2 is a partial cut-away perspective view of the cleaning apparatus shown in FIG. 1.

FIG. 2 illustrates the internal components of the cleaning apparatus 100 shown in FIG. 1. A cleaning ribbon 203 is dispensed from a supply reel 204 and is collected on a take-up reel 205. Both the supply reel 204 and the take-up reel 205 are rotatably mounted within the housing 201. In the present embodiment, a ribbon advancing reel 211 is directly coupled to the take-up reel 205, thus allowing a user to manually advance the cleaning ribbon 203 from the supply reel 204 whenever necessary.

A guiding system 270 is mounted within the housing 201 to maintain proper orientation of the cleaning ribbon 203. In this embodiment, the guiding system 270 consists of a plurality of rollers 207 and a platen 206. The plurality of rollers 207 and the platen 206 establish the path of the cleaning ribbon 203 between the supply reel 204 and the take-up reel 205, and create tension in the cleaning ribbon 203. The platen 206 also forms a cleaning surface 208 by maintaining a section of the cleaning ribbon 203 parallel to, and in substantial contact with, the surface to be cleaned. The path of the cleaning ribbon 203 and the tension in the cleaning ribbon 203 are established such that there is no lateral movement in the cleaning ribbon 203.

In an alternative embodiment, the guiding system 270 is a track that engages the sides of the cleaning ribbon 203, and directs the cleaning ribbon 203 in a specified path. In a further embodiment, the guiding system 270 may not comprise the rollers 207 and would include only the tension in the cleaning ribbon 203 as established by either a platen 206, or the rotation of the supply reel 204 and take-up reel 205, or a combination thereof.

At the forward edge of the cleaning surface 208, the cleaning ribbon 203 is directed rearwardly, i.e., above the cleaning surface 208 in a direction opposite to the direction of normal travel of the cleaning apparatus 200 so as to create a particle trap 210. In this embodiment, the particle trap 210 is created by the plurality of rollers 207, and an angled portion 209 formed on the forward edge of the platen 206. The angled portion 209 may extend from, or be mounted to, the stationary surface 206. In alternative embodiments, the angled surface could be separately mounted within the housing 201 or the angled portion 209 may not exist at all.

At a location forward of the particle trap 210 is a rotatable brush 212. The rotatable brush 212 is rotatably mounted within the housing 201 and, in a preferred embodiment, is mounted on the same axis as one of the plurality of wheels 202 (shown in FIG. 1). The rotatable brush 212 is covered with a plurality of bristles and acts to propel larger particles from the surface to be cleaned into the particle trap 210. Once in the particle trap 210, particles are collected along with the spent cleaning ribbon 203 by the take-up reel 205. The take-up reel 205 collects the cleaning ribbon 203 so as to maintain a dirty side of the cleaning ribbon 203 facing the take-up reel 205.

While the rotatable brush of the present invention comprises a plurality of bristles, in alternative embodiments, the brush may include a plurality of flexible blades as shown, for example, in U.S. Pat. No. 4,646,380 to Kobayashi, et al. The Kobayashi, et al. patent is hereinafter incorporated by reference. The cleaning ribbon 203 is preferably an electret material like that sold by S. C. Johnson & Son, Inc., of Racine, Wis., under the trademark GRAB-IT™. Additional compositions for the cleaning ribbon 203 could include an adhesive material, a fabric soaked in a cleaning agent, a textured cloth, or any combination thereof, for example.

Figure 3A:
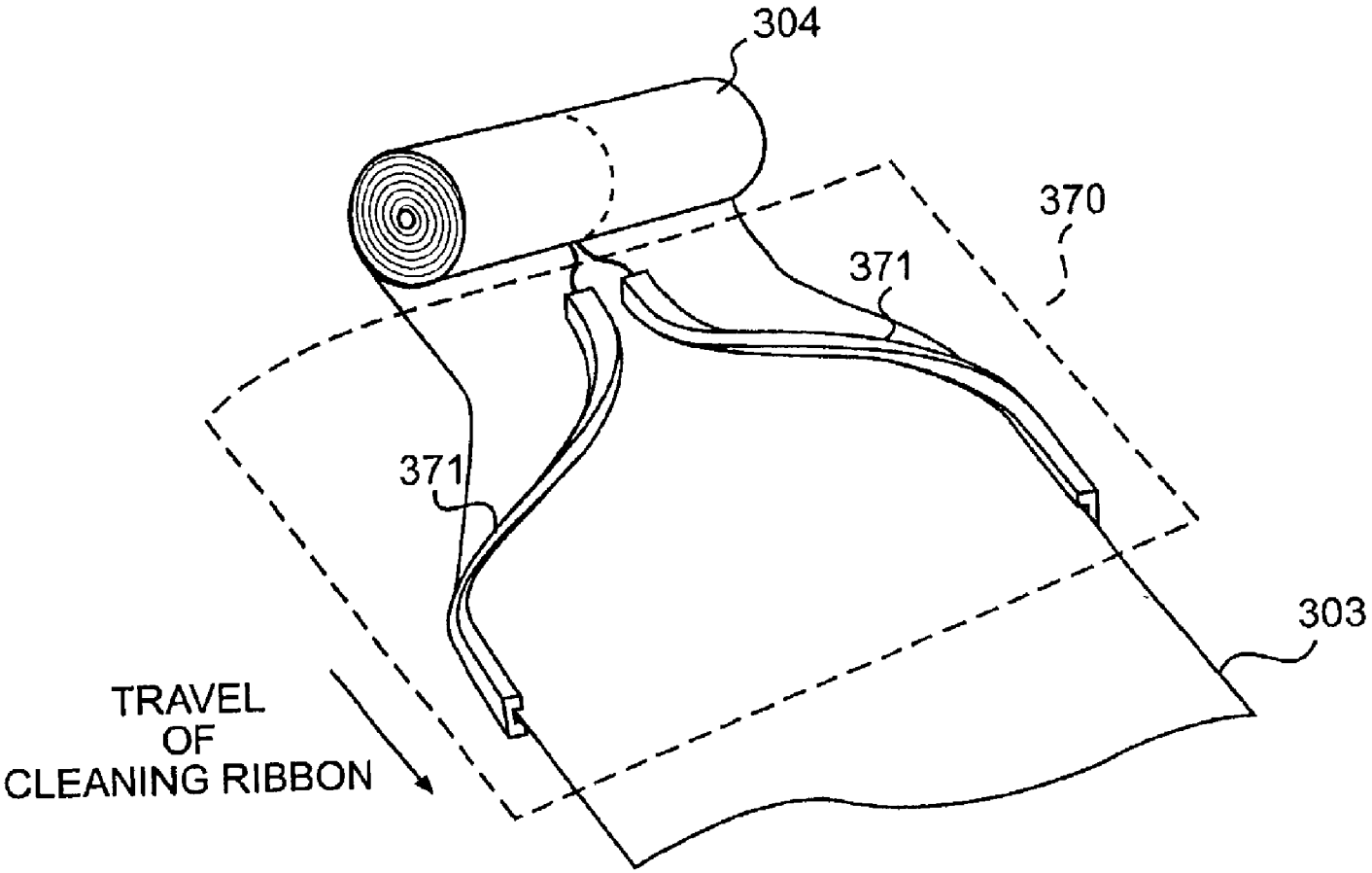
FIGS. 3A and 3B are partial perspective views of alternate embodiments of the present invention.

In the further embodiment depicted in FIG. 3A, the cleaning ribbon 303 is packaged on the supply reel 304 in a manner that reduces the width of the supply reel 304, i.e., the cleaning ribbon 303 is folded at least once lengthwise before being wrapped on the supply reel 304. In such an embodiment, the guiding system 370 includes at least one track 371 formed to accept and substantially constrain at least one side edge of the cleaning ribbon 303 as the cleaning ribbon 303 is unwound. The at least one track 371 forms a contoured path that leads the cleaning ribbon 303 from a folded state to an unfolded state.

Figure 3B:
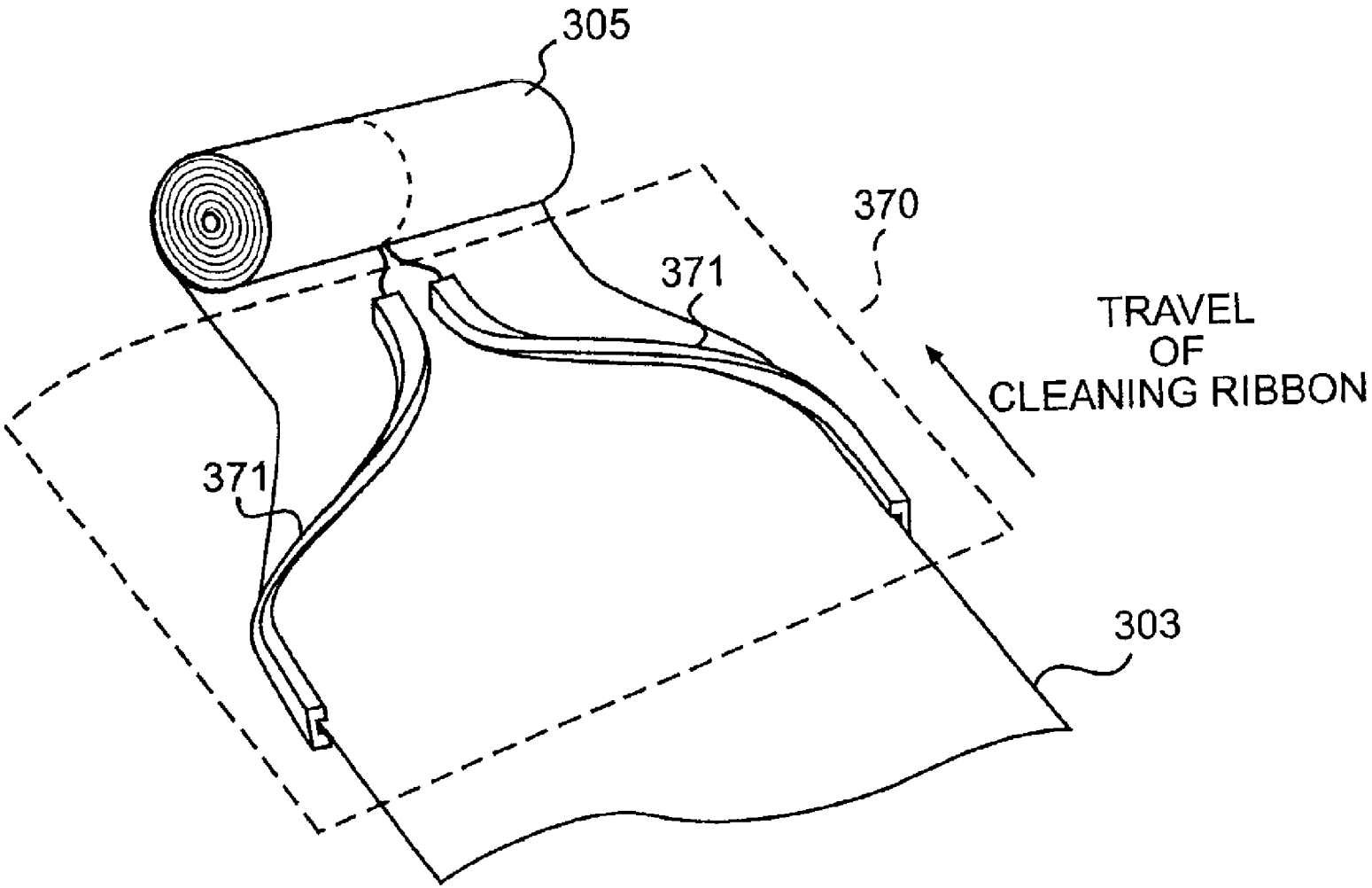

Similarly, FIG. 3B depicts an embodiment in which the cleaning ribbon 303 is folded at least once lengthwise before being collected, thereby reducing the width of the take-up reel 305. Like the embodiment of FIG. 3A, the guiding system 370 includes at least one track 371 formed to accept and substantially constrain at least one side edge of the cleaning ribbon 303. The at least one track 371 is contoured so as to force the constrained at least one side of the cleaning ribbon 303 over the cleaning surface of the cleaning ribbon 303, thereby folding the cleaning ribbon 303. The folded cleaning ribbon 303 can thus be collected by the take-up reel 305.

Figure 4:
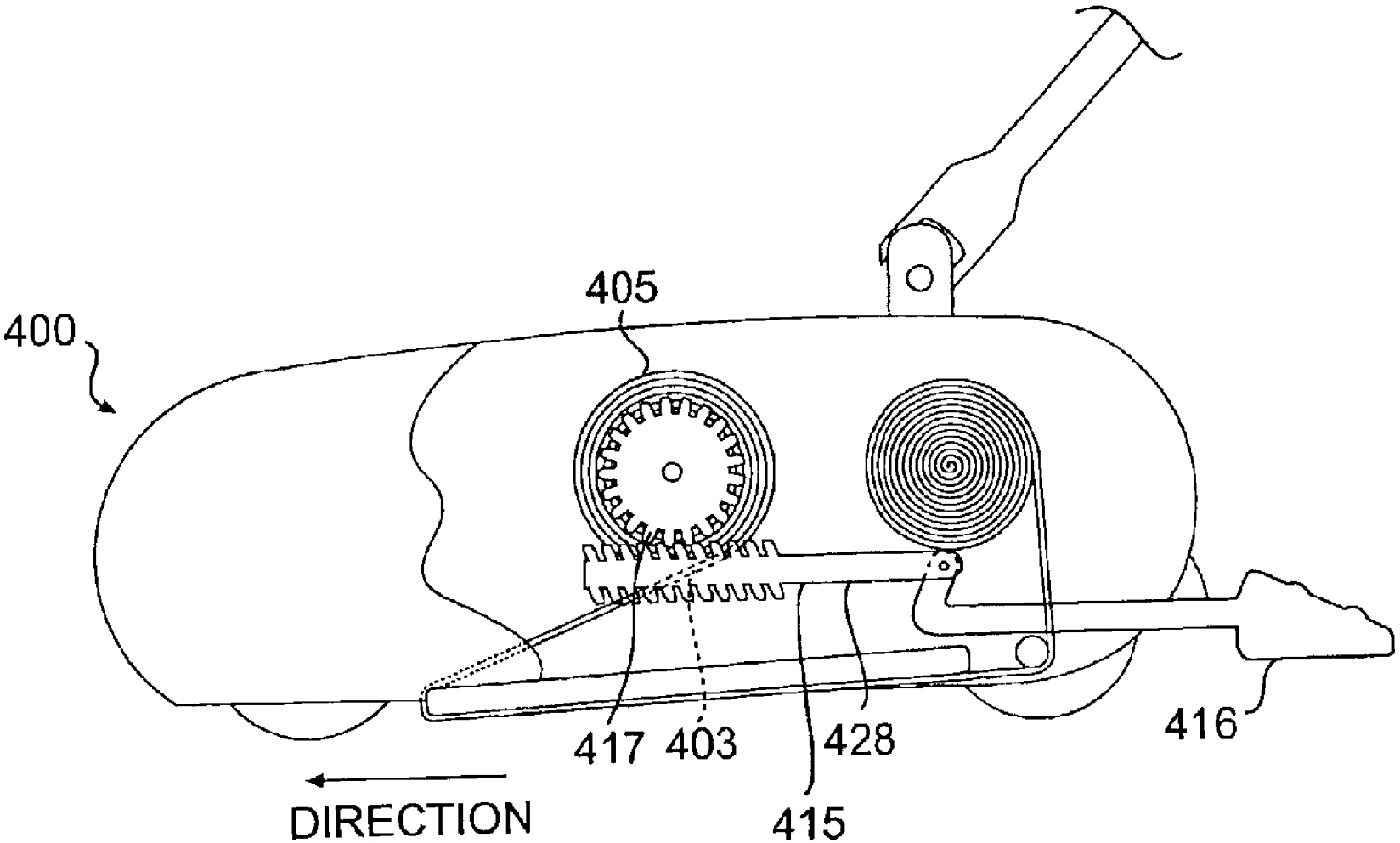
FIG. 4 is a partial cut-away assembly view of another embodiment of the present invention.
Figure 5:
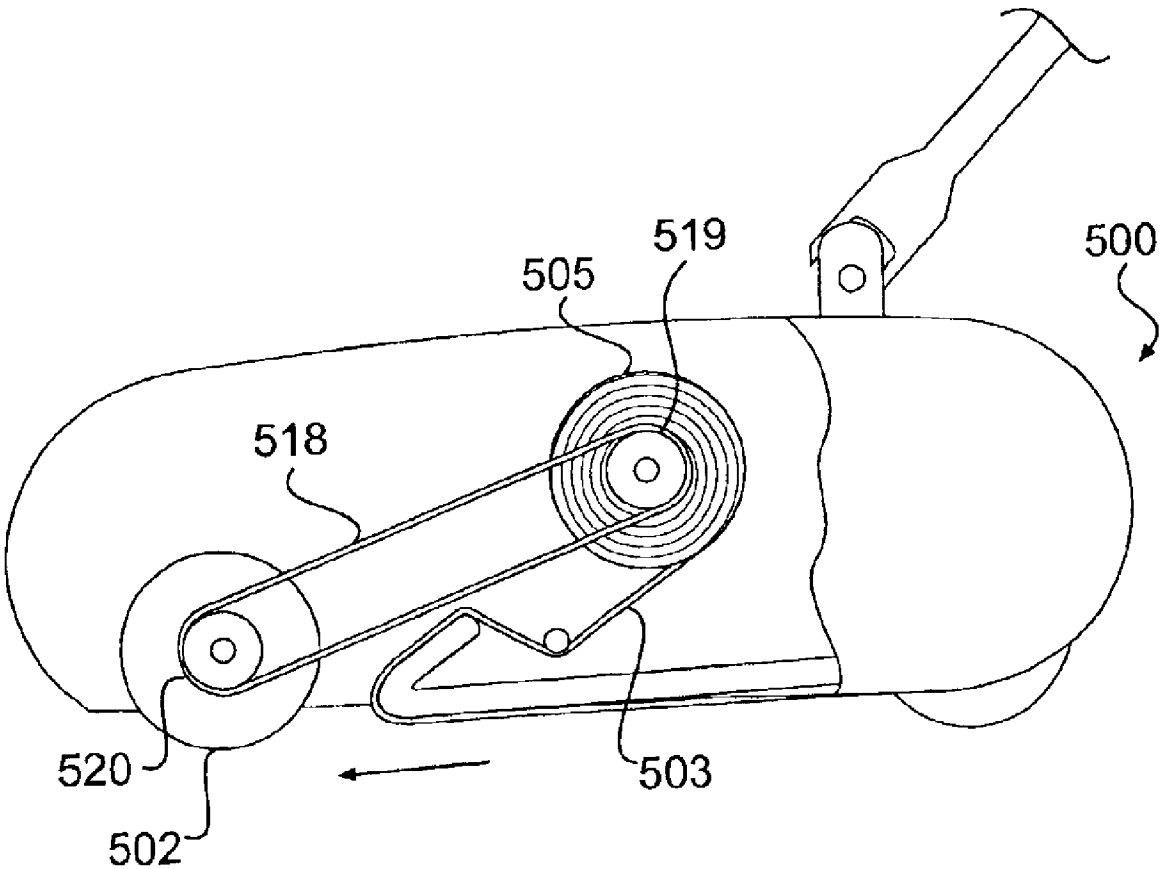
FIG. 5 is a partial cut-away assembly view of yet another embodiment of the present invention.
Figure 6:
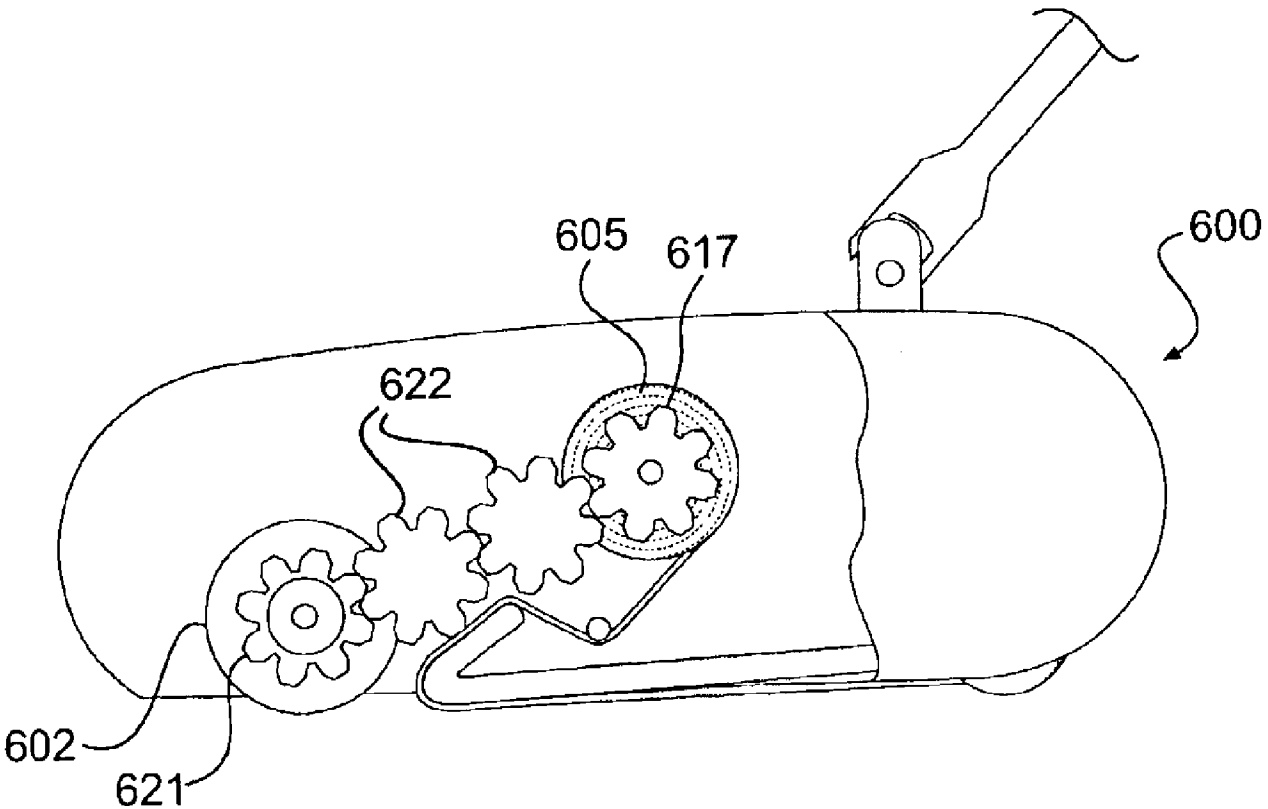
FIG. 6 is a partial cut-away assembly view of still another embodiment of the present invention.

FIGS. 4, 5, and 6 show other preferred embodiments of the invention. The cleaning apparatuses 400, 500, 600 shown in FIGS. 4, 5, and 6 are substantially the same as the embodiment discussed above, and similar parts have been given reference numerals that end in the same two digits. The primary distinction of these embodiments over the foregoing embodiment is that the means to drive the take-up reels 405, 505, 605, and thus advance the cleaning ribbons 403, 503, 603, differs for each.

In FIG. 4, a ratchet mechanism 415 is employed for advancement of the cleaning ribbon 403. By applying pressure to a foot pedal 416, a worm member 428 is moved rearwardly, thus rotating a take-up gear 417. Because the take-up gear 417 is attached to and is an extension of the take-up reel 405, the take-up reel 405 rotates, thus causing the cleaning ribbon 403 to advance.

In FIG. 5, a further embodiment employs a belt 518 to drive the take-up reel 505. A take-up pulley 519 is attached to and is an extension of the take-up reel 505. A wheel pulley 520 is attached to and is an extension of one of the plurality of wheels 502. The belt 518 loops around the take-up pulley 519 and the wheel pulley 520.

Advancing the cleaning apparatus 500 along the surface to be cleaned causes the plurality of wheels 502 to rotate. This simultaneously causes the wheel pulley 520 to rotate, and, as a result, the belt 518 drives the take-up pulley 519. As the take-up pulley 519 rotates, the take-up reel 505 does also, thus advancing the cleaning ribbon 503. By varying the sizes of the wheel pulley 520 and the take-up pulley 519, cleaning potential for the cleaning ribbon 503 can be maximized by setting an optimal value for the rate at which the cleaning ribbon 503 advances with respect to the rate at which the cleaning apparatus 500 moves along the surface to be cleaned.

In FIG. 6, another embodiment utilizes gears to drive the take-up reel 605. A take-up gear 617 is attached to and is an extension of the take-up reel 605. A wheel gear 621 is attached to and is an extension of one of the plurality of wheels 602. As necessary, additional gears 622 may be used to connect the wheel gear 621 and the take-up gear 617.

Advancing the cleaning apparatus 600 along the surface to be cleaned causes the plurality of wheels 602 to rotate. This, in turn, causes the wheel gear 621 to rotate, and, as a result, driving power is transferred through the additional gears 622 to drive the take-up gear 617. Thus, the cleaning ribbon 603 is advanced. By varying the sizes of the wheel gear 621, the take-up gear 617, and the additional gears 622, cleaning potential for the cleaning ribbon 603 can be maximized by setting an optimal value for the rate at which the cleaning ribbon 603 advances with respect to the rate at which the cleaning apparatus 600 moves along the surface to be cleaned.

Figure 7:
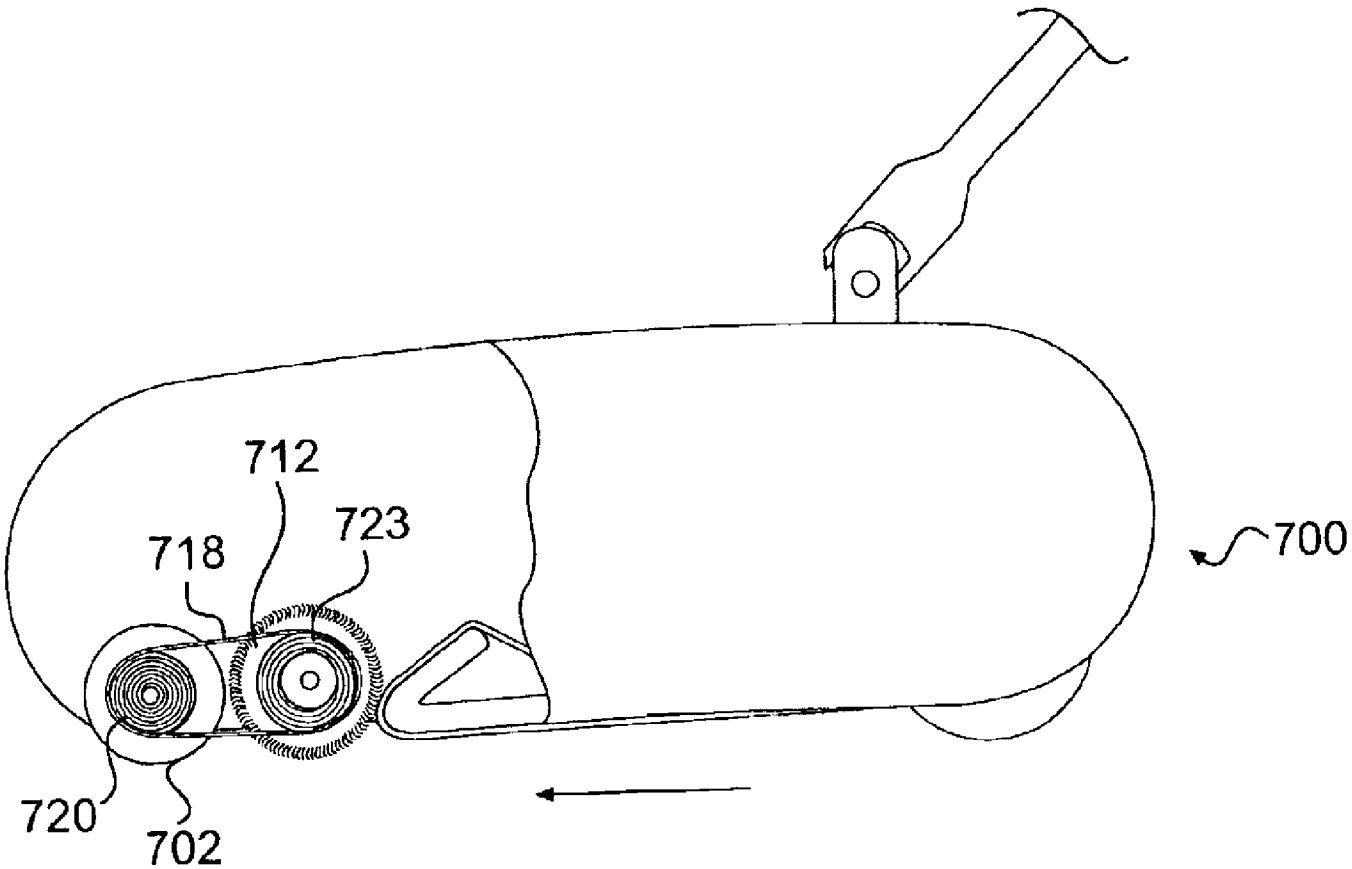
FIG. 7 is a partial cut-away assembly view of a further embodiment of the present invention.
Figure 8:
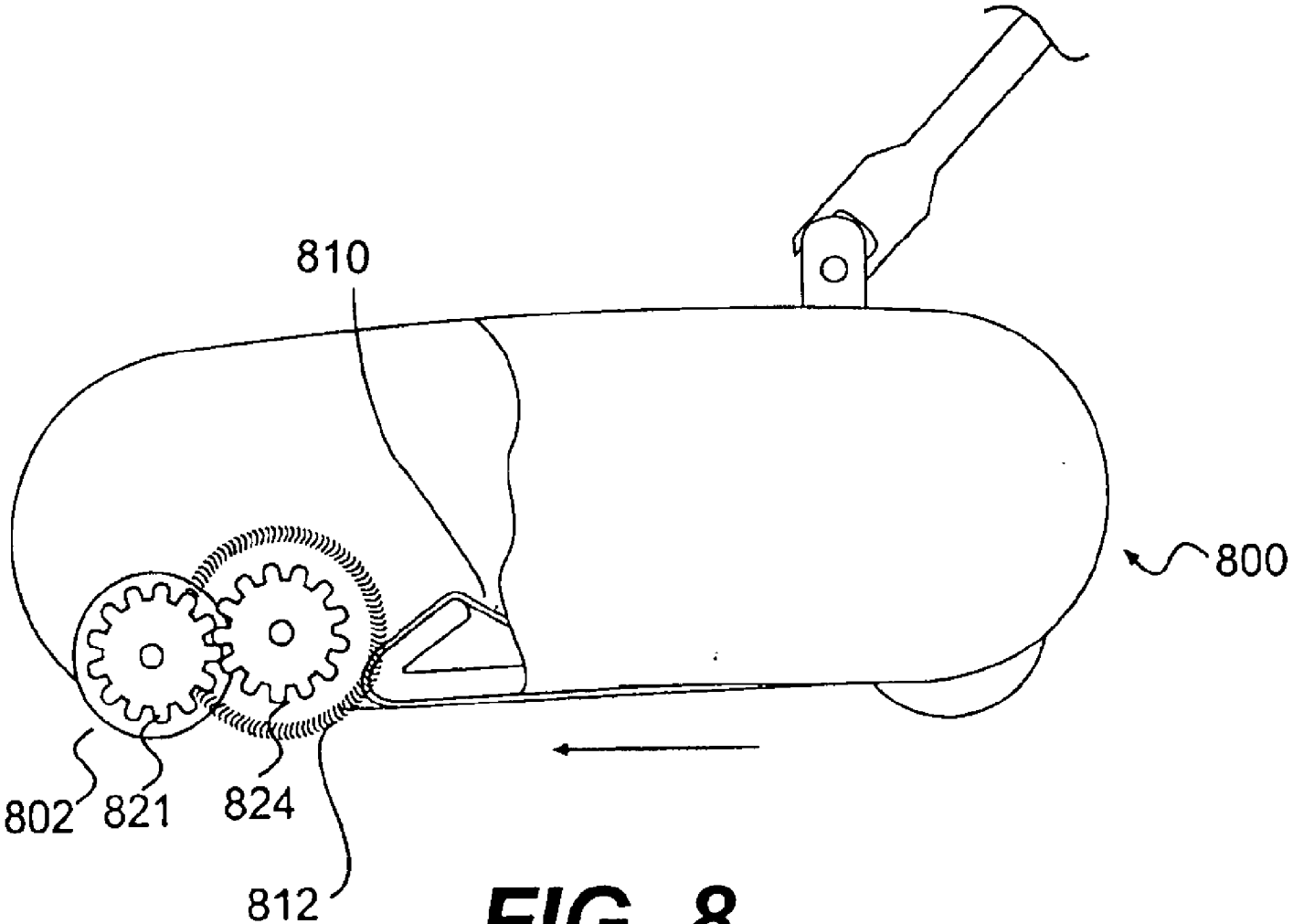
FIG. 8 is a partial cut-away assembly view of a still further embodiment of the present invention.

FIGS. 7 and 8 show other preferred embodiments of the invention. The cleaning apparatuses 700, 800 shown in FIGS. 7 and 8 are substantially the same as the embodiments discussed above, and similar parts have been given reference numerals that end in the same two digits. The primary distinction of these embodiments over the foregoing embodiments is that the means to drive the rotatable brushes 712, 812 differs for each.

In FIG. 7, an embodiment is depicted that uses a belt 718 to drive the rotatable brush 712. A brush pulley 723 is attached to and is an extension of the rotatable brush 712. A wheel pulley 720 is attached to and is an extension of one of the plurality of wheels 702. The belt 718 loops around the brush pulley 723 and the wheel pulley 720.

Advancing the cleaning apparatus 700 along the surface to be cleaned causes the plurality of wheels 702 to rotate. This, in turn, causes the wheel pulley 720 to rotate, and, as a result, the belt 718 drives the brush pulley 723. As the brush pulley 723 rotates, the rotatable brush 712 does also. By varying the sizes of the wheel pulley 720 and the brush pulley 723, cleaning potential for the rotatable brush 712 can be maximized by setting an optimal value for the rate at which the rotatable brush 712 advances with respect to the rate at which the cleaning apparatus 700 moves along the surface to be cleaned.

In FIG. 8, a further embodiment is disclosed that uses gears to drive the rotatable brush 812. A wheel gear 821 is attached to and is an extension of one of the plurality of wheels 802. A brush gear 824 is attached to and is an extension of the rotatable brush 812. As necessary, additional gears (not shown) may be used to connect the wheel gear 821 and the brush gear 824.

Advancing the cleaning apparatus 800 along the surface to be cleaned causes the plurality of wheels 802 to rotate. This, in turn, causes the wheel gear 821 to rotate, and, as a result, the brush gear 824 is driven. By varying the sizes of the wheel gear 821 and the brush gear 824, cleaning potential for the rotatable brush 812 can be maximized by setting an optimal value for the rate at which the rotatable brush 812 advances with respect to the rate at which the cleaning apparatus 800 moves along the surface to be cleaned. Alternatively, the cleaning apparatus of FIG. 8 could be configured such that the rotatable brush 812 always rotates in a direction to propel dust particles into the particle trap 810. By employing, for example, a clutch in conjunction with the gearing, the rotatable brush 812 could always rotate to propel dust particles into the particle trap 810, regardless of the direction of movement of the cleaning apparatus 800.

Figure 9:
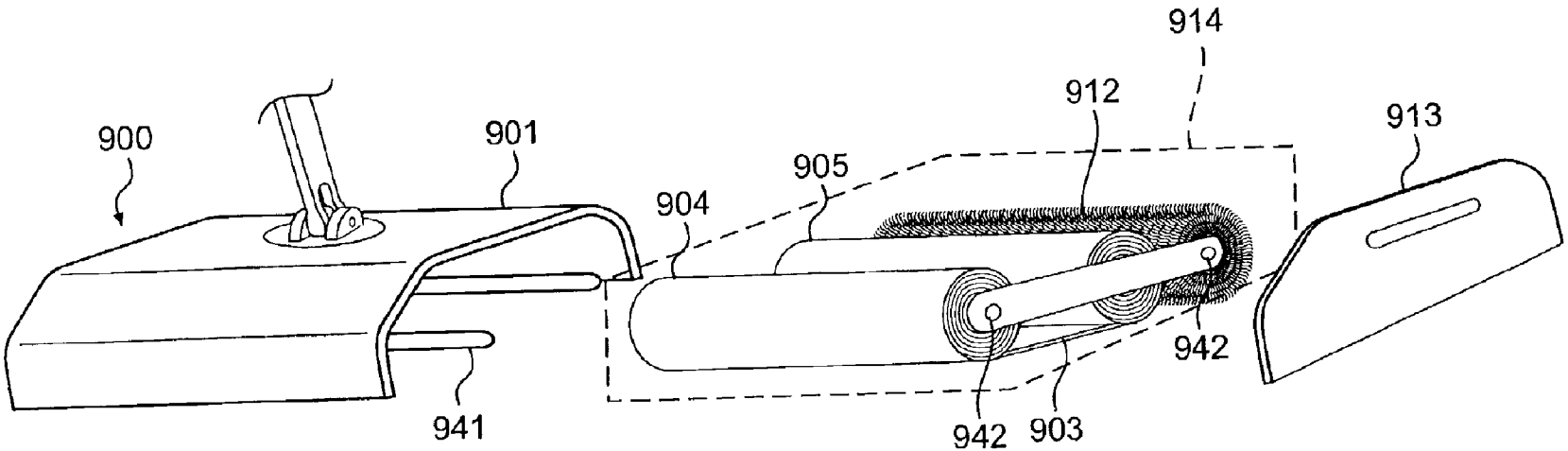
FIG. 9 is a partial cut-away assembly view of an additional embodiment of the present invention.
Figure 10:
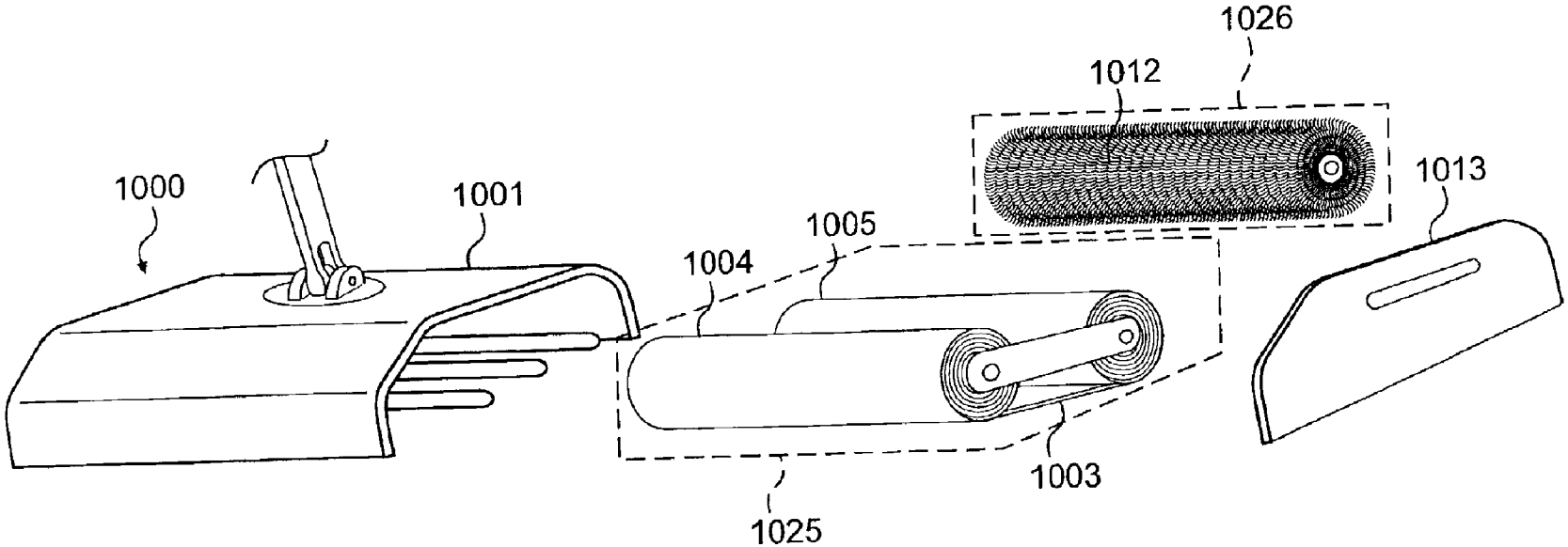
FIG. 10 is a partial cut-away assembly view of a further embodiment of the present invention.

FIGS. 9 and 10 illustrate still other preferred embodiments of the invention. The cleaning apparatuses 900, 1000 shown in FIGS. 9 and 10 are substantially the same as the embodiments discussed above, and similar parts have been given reference numerals that end in the same two digits. The primary distinction of these embodiments over the foregoing embodiments is that the supply reels 904, 1004, the take-up reels 905, 1005, the cleaning ribbons 903, 1003, and/or the rotatable brushes 912, 1012 are detachably secured.

According to the embodiment of FIG. 9, the housing 901 includes a detachably secured housing panel 913 and at least one mounting protrusion 941. Removal of the housing panel 913 exposes the at least one mounting protrusion 941 and allows for removal and replacement of a cartridge 914. The cartridge 914 comprises the supply reel 904, the take-up reel 905, the cleaning ribbon 903, which may be preformed to create a particle trap, the rotatable brush 912, and necessary means to detachably secure the cartridge 914 within the housing 901. This securement means may be embodied such that the cartridge 914 contains at least one aperture 942 for mating with the at least one mounting protrusion 941. As shown in FIG. 9, the at least one aperture 942 may be formed through the rotational axis of either the supply reel 904, the take-up reel 905, the rotatable brush 912, or any combination therebetween. In this embodiment, the mounted supply reel 904, take-up reel 905, or rotatable brush 912 may either rotate about the mounting protrusion 941 or the mounting protrusion 941 and the mounted supply reel 904, take-up reel 905, or rotatable brush 912 may rotate in unison (e.g., by forming the at least one mounting protrusion 941 and the at least one mounting aperture 942 with non-circular, identical cross sections). Additionally, in other embodiments, the securement means for the cartridge 914 includes any gearing or hardware that would mate with components within the housing 901 for driving the supply reel 904, the take-up reel 905, and/or the rotatable brush 912.

A significant advantage of this embodiment is that the cleaning ribbon 903 and rotatable brush 912 can be used to their maximum cleaning potential and can then be easily replaced when necessary; the cleaning apparatus 900 need not be exchanged entirely. While in one embodiment of the invention the cartridge 914 is disposable, in another embodiment, the cartridge may be detached merely to facilitate replacement of the cleaning ribbon 903, or to allow for cleaning of the rotatable brush 912.

Similar to the housing 901 of FIG. 9, the housing 1001 of FIG. 10 includes a detachably secured housing panel 1013. Removal of the housing panel 1013 allows for removal and replacement of either a reel cartridge 1025 comprising the supply reel 1004, the take-up reel 1005, the cleaning ribbon 1003, and the means necessary to detachably secure the reel cartridge 1025 within the housing 1001, or a brush cartridge 1026 comprising the rotatable brush 1012 and the necessary means to detachably secure the disposable brush cartridge 1026 within the housing 1001, or both the reel cartridge 1025 and the brush cartridge 1026. For the reel cartridge 1025, the cleaning ribbon may be preformed to create a particle trap. The securement means for the reel cartridge 1025 and the brush cartridge 1026 is substantially the same as that discussed for the cartridge 914 and will not be discussed further. Like the embodiment shown in FIG. 9, this arrangement allows for maximization of cleaning potential. This embodiment, however, further allows the user to replace only the cleaning ribbon 1003 or only the rotatable brush 1012 in the instance that the two soil at different rates. Also similar to the embodiment of FIG. 9, the reel cartridge 1025 and the brush cartridge 1026 may be disposable, or in a further embodiment, the reel cartridge 1025 and the brush cartridge 1026 may be removed to facilitate either replacement of the cleaning ribbon 1003 or cleaning of the rotatable brush 1012.

Figure 11:
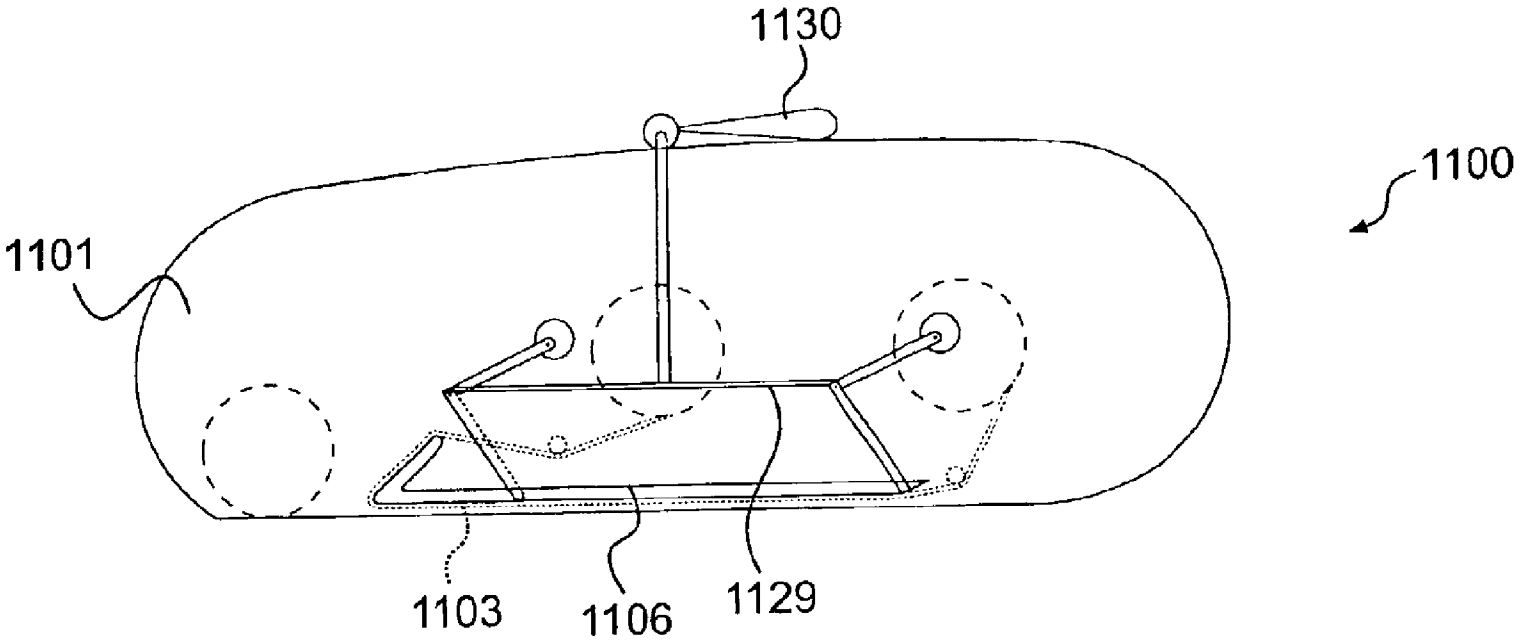
FIG. 11 is a partial cut-away assembly view of another embodiment of the present invention.

FIG. 11 illustrates another embodiment of the invention. The cleaning apparatus 1100 shown in FIG. 11 is substantially the same as the embodiments discussed above, and similar parts have been given reference numerals that end in the same two digits. The primary distinction of this embodiment over the foregoing embodiments is that the platen 1106 is movable with respect to the housing 1101.

According to the embodiment of FIG. 11, the platen 1106 is held parallel to the surface to be cleaned by a linkage 1129. The platen 1106 may be moved with respect to the housing 1101 by a lever 1130 through the linkage 1129. By moving the platen 1106, the apparatus may be used on different surfaces (e.g., carpeting or rugs) and the cleaning ribbon 1103 may be more easily replaced. The manner shown in this embodiment is merely representative. A number of linkages or linkage-type devices could be used. Additionally, a number of means other than a hand-lever could be used to operate the linkage, including a foot-operated lever, or a motor, for example. If a motor is used, the raising and lowering of the platen 1106 may be done automatically by the apparatus 1100. By sensing the movement of the apparatus 1100 onto a new surface to be cleaned (e.g., movement from a hard floor to a carpet) the apparatus 1100 would automatically raise or lower the platen 1106 for uninterrupted cleaning on multiple surfaces. Such sensing of a new surface would be done, for example, by realizing a change in rolling resistance of the apparatus 1100 created by changing frictional characteristics of differing floor types.

Figure 12:
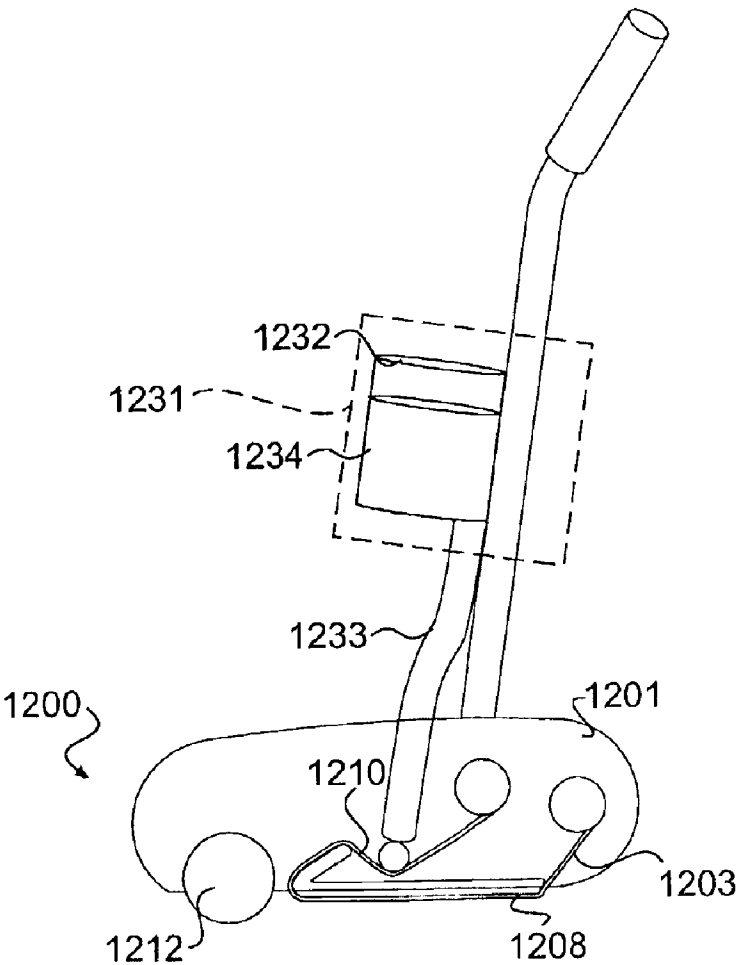
FIG. 12 is a partial cut-away assembly view of yet another embodiment of the present invention.

FIG. 12 shows a still further embodiment of the invention. The cleaning apparatus 1200 shown in FIG. 12 is substantially the same as the embodiments discussed above, and similar parts have been given reference numerals that end in the same two digits. The primary distinction of this embodiment over the foregoing embodiments is that suction is used in conjunction with the cleaning ribbon 1203 and the rotatable brush 1212.

According to FIG. 12, a vacuum unit 1231 includes a compressor 1232 for creating a low pressure suction, a length of vacuum tube 1233 extending from the compressor 1232 to within the housing 1201 for aiding in debris collection, and a debris container 1234 for containing debris collected by the vacuum tube 1233. In one embodiment, the vacuum unit 1231 removes debris directly from the particle trap 1210. Alternatively, the suction can be applied to the portion of the cleaning ribbon 1203 that creates the cleaning surface 1208 on a side of the cleaning ribbon 1203 opposite the surface to be cleaned. In this way, the cleaning ribbon's 1203 ability to retain particles is enhanced. As a further variation of this embodiment, the suction can be applied to the portion of cleaning ribbon 1203 that forms the particle trap 1210 on a side of the cleaning ribbon 1203 opposite the side of the cleaning ribbon 1203 that retains foreign particles. By so doing, retention of foreign particles within the particle trap 1210 is enhanced.

The embodiments discussed above are representative of embodiments of the present invention and are provided for illustrative purposes only. They are not intended to limit the scope of the invention. Variations and modifications are apparent from a reading of the preceding description and are included within the scope of the invention. The invention is intended to be limited only by the scope of the accompanying claims.

INDUSTRIAL APPLICABILITY

The apparatus of this invention is suited for use in cleaning floors, and is particularly useful for household use on hard-surfaced floors. The cleaning ribbon disposed parallel to, and in substantial contact with, the floor is effective at attracting and retaining smaller debris particles. As the apparatus is moved along the surface to be cleaned, the rotatable brush acts to sweep larger debris particles into a particle trap. By collecting smaller and larger debris particles, the apparatus effectively cleans an entire surface with minimal manual interaction.

I claim:

1. A cleaning apparatus, comprising:

a housing;

a supply reel secured within the housing;

a take-up reel secured within the housing;

a cleaning ribbon extending from the supply reel to the take-up reel, the cleaning ribbon being configured to form a particle trap; and a rotatable brush secured within the housing, wherein the rotatable brush is disposed on a forward side of the particle trap, and sweeps debris into the particle trap upon rotation of the rotatable brush.

2. The cleaning apparatus according to claim 1, further comprising a handle attached to the housing for manually moving the housing along a surface to be cleaned.

3. A cleaning apparatus, comprising:

a housing; and a cartridge detachably secured within the housing, the cartridge including:

a supply reel;

a take-up reel;

a cleaning ribbon extending from the supply reel to the take-up reel, the cleaning ribbon being configured to form a particle trap and having a cleaning surface substantially parallel to a surface to be cleaned; and a rotatable brush disposed on a forward side of the cleaning surface, wherein the rotatable brush sweeps particles into the particle trap upon rotation of the rotatable brush.

4. The cleaning apparatus according to claim 3, wherein the housing includes a panel that is removable for providing access to the cartridge.

5. The cleaning apparatus according to claim 3, wherein the cleaning ribbon is comprised of an electret material that electrostatically attracts and retains particles.

6. The cleaning apparatus according to claim 3, wherein the cleaning ribbon is comprised of an adhesive material.

7. The cleaning apparatus according to claim 3, wherein the cleaning ribbon is saturated with a cleaning agent.

8. The cleaning apparatus according to claim 3, wherein the cleaning ribbon is a textured cloth.

9. The cleaning apparatus according to claim 3, wherein the cleaning ribbon comprises a combination of at least two of an electret material, an adhesive material, a material saturated with a cleaning agent, and a textured cloth.

10. The cleaning apparatus according to claim 3, wherein the cleaning ribbon is in a folded state on the supply reel to reduce its width on the supply reel.

11. The cleaning apparatus according to claim 10, wherein the width of the supply reel is less than the width of the cleaning ribbon in an unfolded state.

12. The cleaning apparatus according to claim 3, wherein the cleaning ribbon is folded before being collected by the take-up reel to reduce its width on the take-up reel.

13. The cleaning apparatus according to claim 12, wherein the width of the take-up reel is less than the width of the cleaning ribbon in an unfolded state.

14. The cleaning apparatus according to claim 3, wherein the cleaning ribbon is in a folded state on the supply reel to reduce its width on the supply reel and the cleaning ribbon is folded before being collected by the take-up reel to reduce its width on the take-up reel.

15. The cleaning apparatus according to claim 3, wherein the supply and take-up reels are mechanically driven.

16. The cleaning apparatus according to claim 15, wherein the supply and take-up reels are driven at a rate different than the rate at which the housing is advanced along the surface to be cleaned.

17. The cleaning apparatus according to claim 3, wherein the rotatable brush comprises a plurality of bristles.

18. The cleaning apparatus according to claim 3, wherein the rotatable brush comprises a plurality of flexible blades.

19. The cleaning apparatus according to claim 3, wherein the rotatable brush is mechanically driven.

20. The cleaning apparatus according to claim 19, wherein the rotatable brush is always driven in the same rotational direction, regardless of the direction of travel of the housing.

21. The cleaning apparatus according to claim 19, further comprising a plurality of rotatable wheels for advancing the housing along the surface to be cleaned, wherein the rotatable brush has a common axis with at least one of the plurality of rotatable wheels.

22. The cleaning apparatus according to claim 19, wherein the rotatable brush is driven at a rate different than the rate at which the housing is advanced along the surface to be cleaned.

23. The cleaning apparatus according to claim 22, further comprising a plurality of wheels for advancing the housing along the surface to be cleaned and a belt and pulley system for rotating the rotatable brush, wherein the belt and pulley system utilizes the rotation of at least one of the plurality of wheels to rotate the rotatable brush.

24. The cleaning apparatus according to claim 22, further comprising a plurality of wheels for advancing the housing along the surface to be cleaned and a plurality of gears for rotating the rotatable brush, wherein the plurality of gears utilizes the rotation of at least one of the plurality of wheels to rotate the rotatable brush.

25. The cleaning apparatus according to claim 3, further comprising a vacuum unit for supplying a suction within the housing.

26. The cleaning apparatus according to claim 25, wherein the suction within the housing removes particles from the particle trap.

27. The cleaning apparatus according to claim 25, wherein the suction within the housing is applied to the portion of the cleaning ribbon that creates the cleaning surface on a side of the cleaning ribbon opposite the surface to be cleaned.

28. The cleaning apparatus according to claim 25, wherein the suction within the housing is applied to a side of the portion of the cleaning ribbon forming the particle trap, opposite a side on which particles are collected.

29. A cleaning apparatus, comprising:

a housing;

means for advancing the housing along a surface to be cleaned;

a supply reel secured within the housing for dispensing a supply of cleaning ribbon;

a take-up reel secured within the housing for collecting spent cleaning ribbon;

means within the housing for keeping a portion of the cleaning ribbon which extends between the supply reel and the take-up reel substantially parallel to the surface to be cleaned;

means within the housing for trapping debris; and means secured within the housing for sweeping debris into the debris trapping means.

30. The cleaning apparatus according to claim 29, wherein the advancing means comprises a handle attached to the housing.

31. The cleaning apparatus according to claim 29, wherein the advancing means is self-propelled.

32. The cleaning apparatus according to claim 29, wherein the advancing means is autonomous.

33. The cleaning apparatus according to claim 29, wherein the take-up reel collects the cleaning ribbon so that a side of the cleaning ribbon that was in substantial contact with the surface to be cleaned faces the take-up reel.

34. The cleaning apparatus according to claim 29, wherein the means for keeping the portion of the cleaning ribbon which extends between the supply reel and the take-up reel parallel to the surface to be cleaned comprises a guiding system.

35. The cleaning apparatus according to claim 34, wherein the guiding system prevents the cleaning ribbon from moving laterally relative to the housing.

36. The cleaning apparatus according to claim 34, wherein the guiding system comprises a platen.

37. The cleaning apparatus according to claim 36, further comprising means for movably mounting the platen with respect to the housing.

38. The cleaning apparatus according to claim 37, wherein the means for movably mounting the platen with respect to the housing comprises a linkage device.

39. The cleaning apparatus according to claim 37, further comprising a manual lever for operating the linkage device.

40. The cleaning apparatus according to claim 37, wherein the means for movably mounting the platen with respect to the housing comprises a motor.

41. The cleaning apparatus according to claim 37, further comprising sensing means for sensing that the platen must be moved with respect to the housing.

42. The cleaning apparatus according to claim 34, wherein the guiding system comprises a plurality of rollers.

43. The cleaning apparatus according to claim 36, wherein the guiding system configures the cleaning ribbon such as to wrap the cleaning ribbon over a forward portion of the platen, thereby directing the ribbon rearwardly over the portion of the cleaning ribbon which extends between the supply reel and the take-up reel parallel to the surface to be cleaned.

44. The cleaning apparatus according to claim 43, wherein the forward portion of the platen comprises an angled member.

45. The cleaning apparatus according to claim 29, wherein the means for sweeping debris into the debris trapping means comprises a rotatable brush disposed on the forward side of the debris trapping means.

46. The cleaning apparatus according to claim 29, wherein the means for sweeping debris into the debris trapping means is comprised of a plurality of rotatable brushes disposed on the forward side of the debris trapping means.

47. The cleaning apparatus according to claim 29, further comprising a mechanical drive system for advancing the cleaning ribbon.

48. The cleaning apparatus according to claim 47, wherein the mechanical drive system comprises a ribbon advancing reel coupled directly to the take-up reel.

49. The cleaning apparatus according to claim 47, wherein the mechanical drive system comprises a foot-pedal operated ratchet mechanism.

50. The cleaning apparatus according to claim 47, wherein the mechanical drive system controls the rate of advancement of the cleaning ribbon relative to the rate at which the housing is advanced along the surface to be cleaned.

51. The cleaning apparatus according to claim 50, further comprising a plurality of wheels for advancing the housing along the surface to be cleaned, wherein the mechanical drive system comprises a belt and pulley system which utilizes the rotation of at least one of the plurality of wheels to advance the take-up reel.

52. The cleaning apparatus according to claim 50, further comprising a plurality of wheels for advancing the housing along the surface to be cleaned, wherein the mechanical drive system comprises a plurality of gears which utilizes the rotation of at least one of the plurality of wheels to advance the take-up reel.

53. The cleaning apparatus according to claim 29, further comprising a motor for advancing the take-up reel.

54. The cleaning apparatus according to claim 29, further comprising a vacuum unit for supplying a suction within the housing.

55. The cleaning apparatus according to claim 54, wherein the suction within the housing removes debris from the means for trapping debris.

56. The cleaning apparatus according to claim 54, wherein the suction within the housing is applied to the portion of the cleaning ribbon which extends between the supply reel and the take-up reel and substantially parallel to the surface to be cleaned on a side of the cleaning ribbon opposite the surface to be cleaned.

57. The cleaning apparatus according to claim 54, wherein the suction within the housing is applied to a side of the means for trapping debris opposite a side that collects debris.

58. A cartridge for detachable securement within a cleaning apparatus, the cartridge comprising:

a supply reel;

a take-up reel;

a cleaning ribbon extending between the supply reel and the take-up reel, the cleaning ribbon being configured so as to form a particle trap;

means for sweeping debris into the particle trap; and means for detachably securing the cartridge to the cleaning apparatus.

59. The cartridge according to claim 58, wherein the sweeping means comprises a rotatable brush.

60. The cartridge according to claim 58, wherein the sweeping means comprises a plurality of rotating brushes.

61. The cartridge according to claim 58, wherein the securing means consists of at least one aperture within the cartridge for mating with at least one protrusion within the cleaning apparatus.

62. The cartridge according to claim 61, wherein the at least one aperture rotates freely about the at least one protrusion.

63. The cartridge according to claim 61, wherein the at least one aperture rotates in unison with the at least one protrusion.

64. The cartridge according to claim 58, wherein a portion of the cleaning ribbon positioned between the supply reel and the take-up reel is wider than the supply reel.

65. The cartridge according to claim 58, wherein a portion of the cleaning ribbon positioned between the supply reel and the take-up reel is wider than the take-up reel.

66. A cartridge for detachable securement within a cleaning apparatus, that includes a housing and a rotatable brush the cartridge comprising:

a supply reel;

a take-up reel;

a cleaning ribbon for being fed along a path between the supply reel and the take-up reel, a length of the cleaning ribbon positioned between the supply reel and the take-up reel being disposed for cleaning a surface to be cleaned when in use, and the cleaning ribbon being configured to form a particle trap along the path of the cleaning ribbon downstream of the length of the cleaning ribbon for cleaning the surface to be cleaned and upstream of the take-up reel, before the cleaning ribbon is collected by the take-up reel; and means for detachably securing the cartridge to the cleaning apparatus, wherein, when the cartridge is mounted in the cleaning apparatus and the cleaning apparatus is in use, the particle trap receives debris swept by the rotatable brush.

67. The cartridge according to claim 66, wherein the securing means comprises at least one aperture within the cartridge for mating with at least one protrusion within the cleaning apparatus.

68. The cartridge according to claim 67, wherein the at least one aperture rotates freely about the at least one protrusion.

69. The cartridge according to claim 67, wherein the at least one aperture rotates in unison with the at least one protrusion.

70. The cartridge according to claim 66, wherein a portion of the cleaning ribbon positioned between the supply reel and the take-up reel is wider than the supply reel.

71. The cartridge according to claim 66, wherein a portion of the cleaning ribbon positioned between the supply reel and the take-up reel is wider than the take-up reel.

72. The cartridge according to claim 66, wherein the cleaning ribbon is in a folded state on at least one of the supply reel and the take-up reel.

73. The cartridge according to claim 66, wherein the particle trap includes a depression between the portion of the cleaning ribbon for cleaning the surface to be cleaned and the take-up reel.

* * * * *